US006406039B1

(12) United States Patent
Chen

(10) Patent No.: US 6,406,039 B1
(45) Date of Patent: Jun. 18, 2002

(54) THREE-WHEEL ROLLER SKATE

(76) Inventor: Jung-Hong Chen, No. 1055, Chung Cheng Rd., Taoyuan City (TW)

( * ) Notice: Subject to any disclaimer, the term of this patent is extended or adjusted under 35 U.S.C. 154(b) by 0 days.

(21) Appl. No.: 10/015,046

(22) Filed: Oct. 22, 2001

(51) Int. Cl.[7] ..... A63C 17/04

(52) U.S. Cl. ..... 280/11.27; 280/11.19; 403/348; 403/378

(58) Field of Search ..... 16/30, 38, 43; 403/319, 348, 324, 378, 379.5; 280/11.19, 841, 11.231, 11.204, 11.223, 11.27, 11.28, 11.206, 304, 304.1, 755

(56) References Cited

U.S. PATENT DOCUMENTS

| | | | | | |
|---|---|---|---|---|---|
| 48,929 | A | * | 7/1865 | Gregg | 280/11.19 |
| 1,144,134 | A | * | 6/1915 | Jones | 280/11.19 |
| 1,194,102 | A | * | 8/1916 | Webb | 280/11.19 |
| 1,608,368 | A | * | 11/1926 | Bugg | 280/11.27 |
| 1,632,997 | A | * | 6/1927 | Connolly | 280/11.19 |
| 1,854,188 | A | * | 4/1932 | Gregory | 280/11.19 |
| 2,474,082 | A | * | 6/1949 | Wutz | 280/11.19 |
| 3,848,883 | A | * | 11/1974 | Breacain | 280/304.1 |

* cited by examiner

*Primary Examiner*—Michael Mar
(74) *Attorney, Agent, or Firm*—Pro-Techtor International Services

(57) ABSTRACT

A three-wheel roller skate comprises a sole plate and a connecting member mounted in the sole plate. An inner rod is extended through the connecting member. A wheel rod is integrally formed with an end of the inner end and provides an axle for mounting a rear wheel. The connecting member comprises a longitudinal through-slot and a groove in an end face thereof. A pin extends through a transverse hole in an end of the inner rod that extends through a longitudinal hole of the connecting member. The pin is turned through an angle so as to place the pin into the groove of the connecting member. A nut engaged on a threaded section of the inner rod is then turned to move the rear wheel away from the sole plate to a locked state.

10 Claims, 9 Drawing Sheets

THREE-WHEEL ROLLER SKATE

BACKGROUND OF THE INVENTION

1. Field of the Invention

The present invention relates to a three-wheel roller skate adopting a single rear wheel that can be easily assembled and that has a low cost and low resistance.

2. Description of the Related Art

A typical conventional roller skate comprises four wheels, two at the front and two at the rear. The axle distance between the front wheels and the rear wheels is short, regardless of the types of the roller skates Further, in addition to high cost, the four wheels have a large contact area with the ground and thus have a large resistance.

SUMMARY OF THE INVENTION

An object of the present invention is to provide a three-wheel roller skate three-wheel roller skate adopting a single rear wheel that can be easily assembled and that has a low cost and low resistance.

A three-wheel roller skate comprises a sole plate, two front wheels rotatably attached to a front portion of the sole plate, and a rear wheel assembly. The rear wheel assembly comprises a connecting member, a wheel rod, an inner rod, and a rear wheel. The connecting member is securely attached to a rear end of the sole plate and comprises a longitudinal hole, a longitudinal through-slot, and a groove. The groove is defined in an end face of the connecting member and extends along a direction at an angle with the longitudinal through-slot. The wheel rod comprises a first end and a second end, the second end of the wheel rod forming an axle to which the rear wheel is rotatably mounted. The rear wheel is located behind the rear end of the sole plate after assembly. The inner rod has a first end extending through the longitudinal hole of the connecting member and a second end integral with the first end of the wheel rod. The inner rod further comprises a threaded section, and a nut is engaged on the threaded section. A transverse hole is defined in the first end of the inner rod, and a pin is extended through the transverse hole of the first end of the inner rod. In assembly, the wheel rod is rotatable through an angle for placing the pin into the groove of the connecting member, and the nut is then rotated to move the rear wheel and the wheel rod relative to the sole plate to a locked state.

A spring may be mounted around the second end of the inner rod. The spring is compressed when the nut is in the locked state. The longitudinal hole of the connecting member may comprise an enlarged section in an end thereof. The threaded section of the inner rod is partially received in the enlarged section of the longitudinal hole of the connecting member. The sole plate may comprise a receptacle for receiving the connecting member. The wheel rod is substantially U-shaped having two limbs, wherein one of the limbs forms the axle for the rear wheel. The pin has a length smaller that a width of the longitudinal through-slot. The nut presses against another end face of the connecting member when in the locked state. The first end of the inner rod has a diameter smaller than that of the second end of the inner rod.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
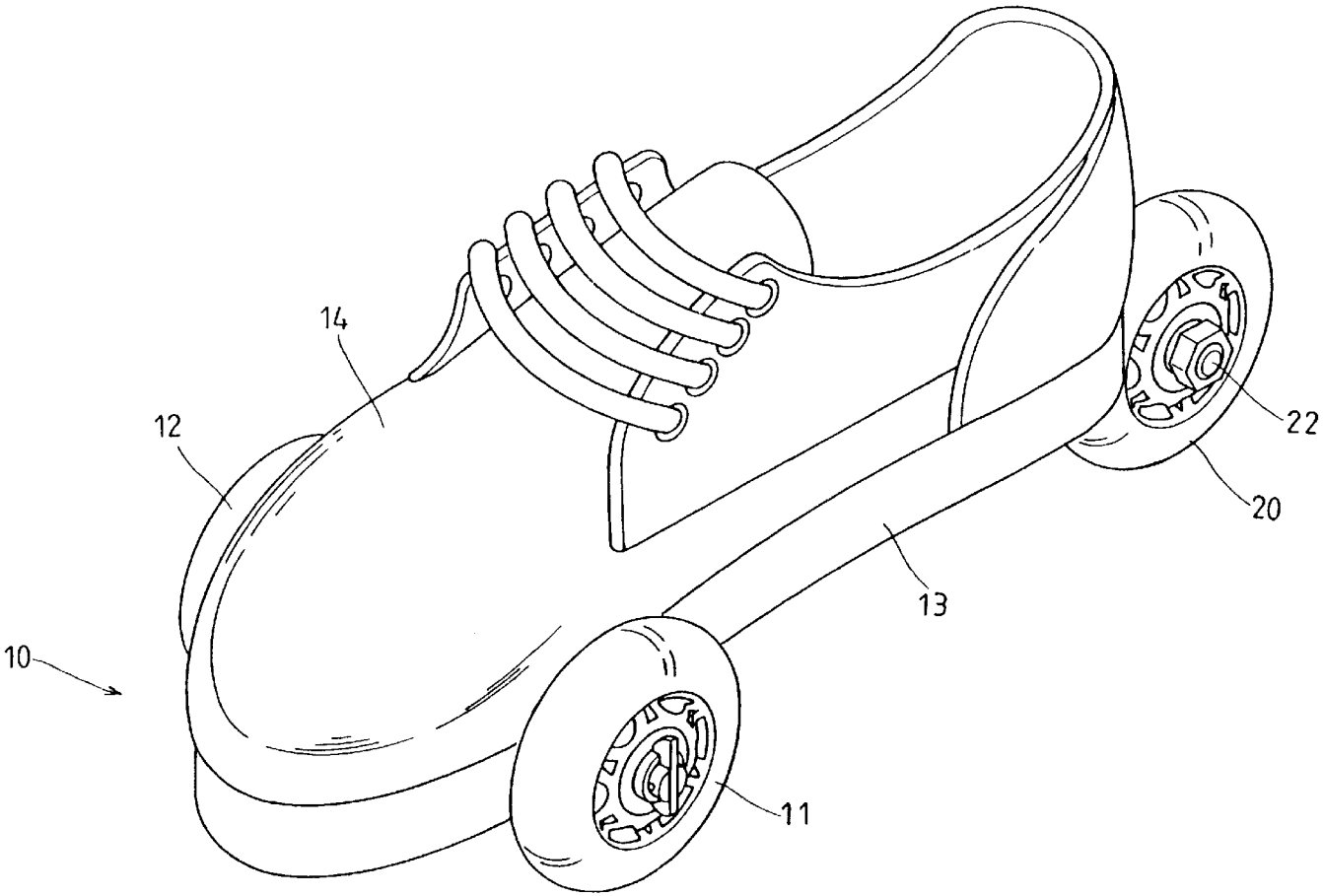
FIG. 1 is a perspective view of a three-wheel roller skate in accordance with the present invention.

Referring to FIG. 1, a three-wheel roller skate in accordance with the present invention is designated by reference numeral 10 and generally comprises a sole plate 13, an upper 14 mounted on top of the sole plate 13, a pair of front wheels 11 and 12 mounted to a front portion of the sole plate 13, and a rear wheel assembly attached to a rear portion of the sole plate 13. The front wheels 11 and 12 can be of any conventional design. The rear wheel assembly comprises a rear wheel 20 located behind the sole plate 13 to thereby provide an increased axle distance. Namely, the distance between a front axle for mounting the front wheels 11 and 12 and a rear axle 22 for mounting the rear wheel 20 is larger than that in conventional four-wheel roller skates. In addition, the frictional force of the three-wheel roller skate is smaller than that of the conventional four-wheel roller skates.

Figure 2:
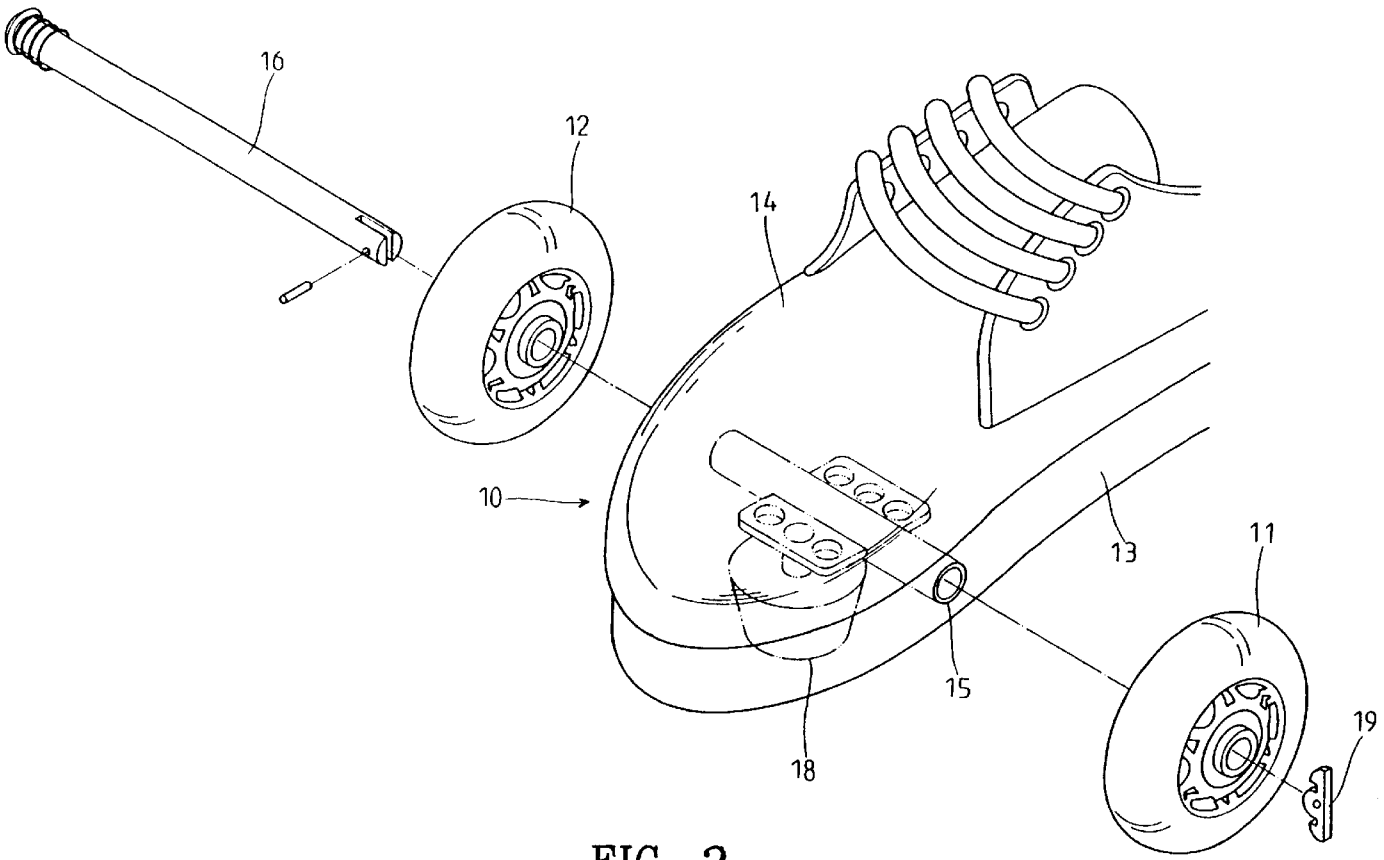
FIG. 2 is an exploded perspective view of a front portion of the three-wheel roller skate in accordance with the present invention.

Referring to FIG. 2, a transverse tube 15 is mounted to the front portion of the sole plate 13, and an axle 16 is extended through the transverse tube 15. The front wheels 11 and 12 are respectively, rotatably mounted to two ends of the axle 16 and retained in place by a retainer 19. Also mounted to the front portion of the sole plate 13 is a brake 18 to provide a braking effect when required.

Figure 3:
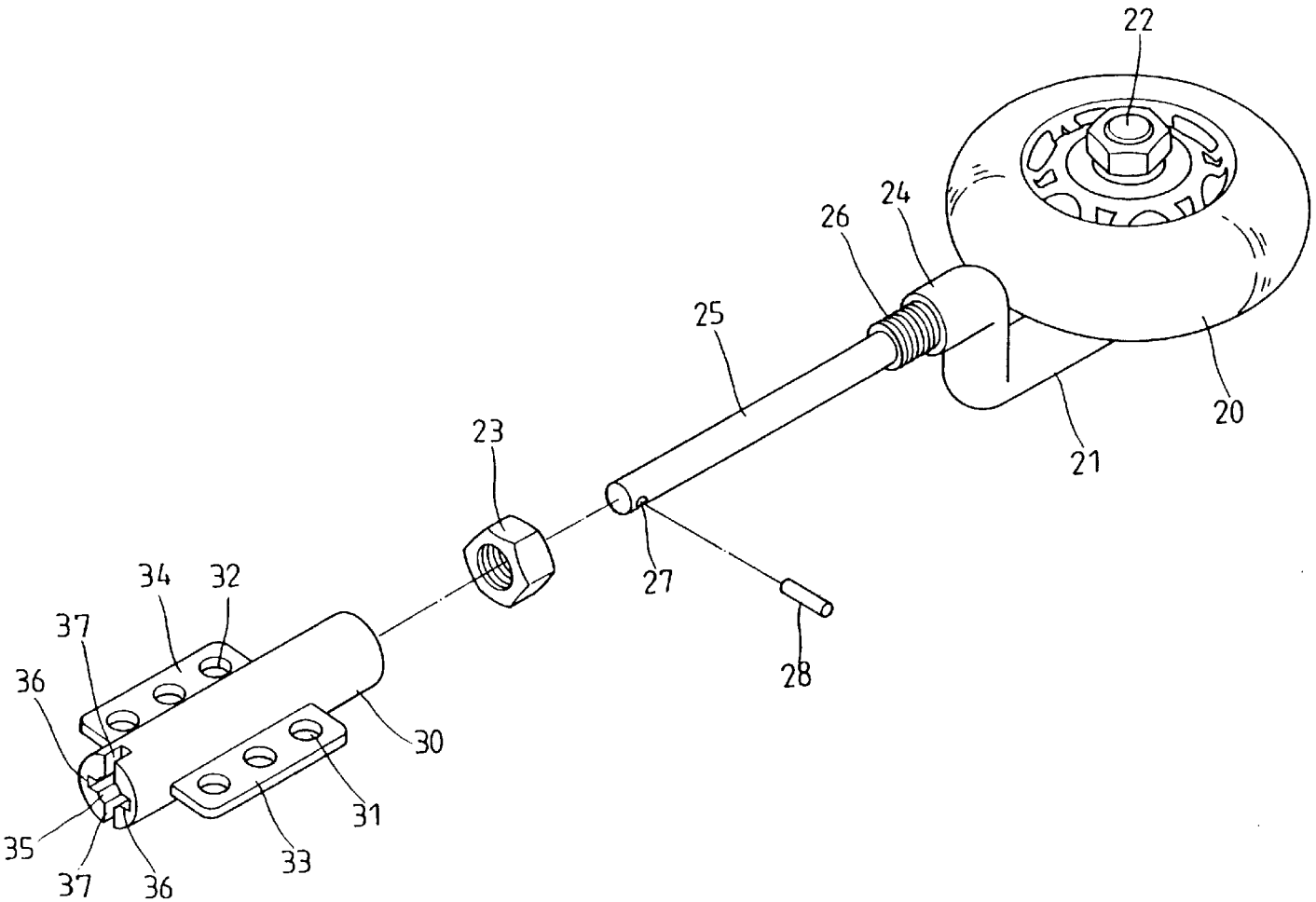
FIG. 3 is an exploded perspective view of a rear wheel assembly of the three-wheel roller skate in accordance with the present invention.

Referring to FIGS. 1 and 3, the rear wheel assembly comprises a connecting member 30 that can be integrally formed with the sole plate 13. In a preferred embodiment of the invention, the connecting member 30 is tubular and comprises two wings 33 and 34 each having plural holes 31, 32 for reliable bonding with the sole plate 13 during formation of the sole plate 13. The connecting member 30 comprises a longitudinal hole 35, a longitudinal through-slot 36, and a groove 37 defined in an end face of the connecting member 30. The groove 37 is at an angle (e.g., right angle) with the longitudinal through-slot 36. The longitudinal through-slot 36 extends along an axis coincident with that of the longitudinal hole 35.

The rear wheel assembly further comprises a substantially U-shaped wheel rod 21 and an inner rod 24 having an end integrally formed with a limb of the U-shaped wheel rod 21. Nevertheless, the inner rod 24 and the wheel rod 21 can be bonded together by any conventional means. The other limb of the U-shaped wheel rod 21 forms an axle 22 to which the rear wheel 20 is rotatably mounted. The inner rod 24 comprises a reduced section 25 that is extended through the longitudinal hole 35 of the connecting member 30. The inner rod 24 further has a threaded section 26 adjacent to the end integrally formed with the U-shaped wheel rod 21. A distal end of the reduced section 25 of the inner rod 24 has a transverse hole 27 through which a pin 28 extends. The pin 28 has a length smaller that the width of the longitudinal through-slot 36. A nut 23 is engaged on the threaded section 26.

Figure 4:
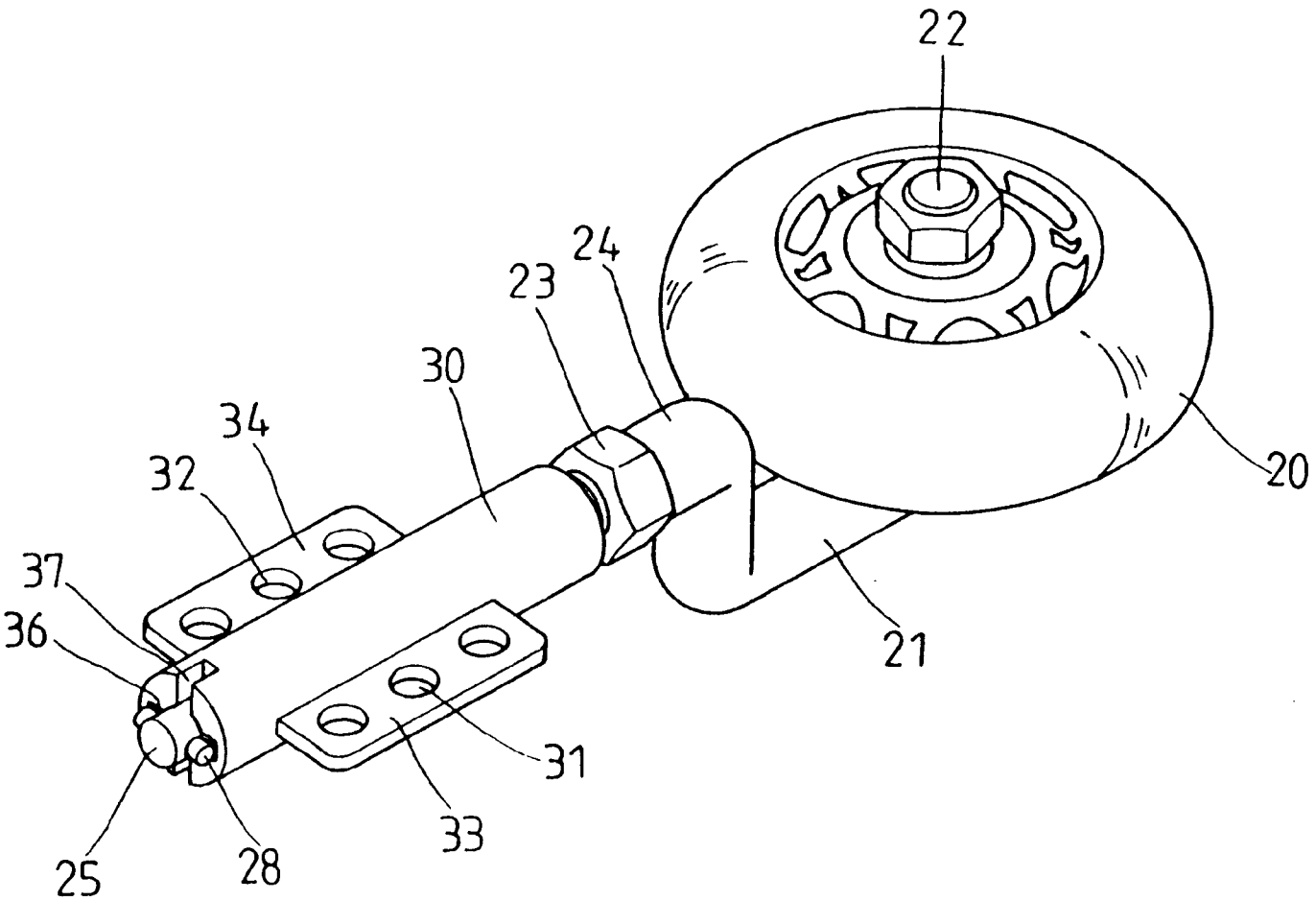
FIG. 4 is a perspective view of the rear wheel assembly.
Figure 5:
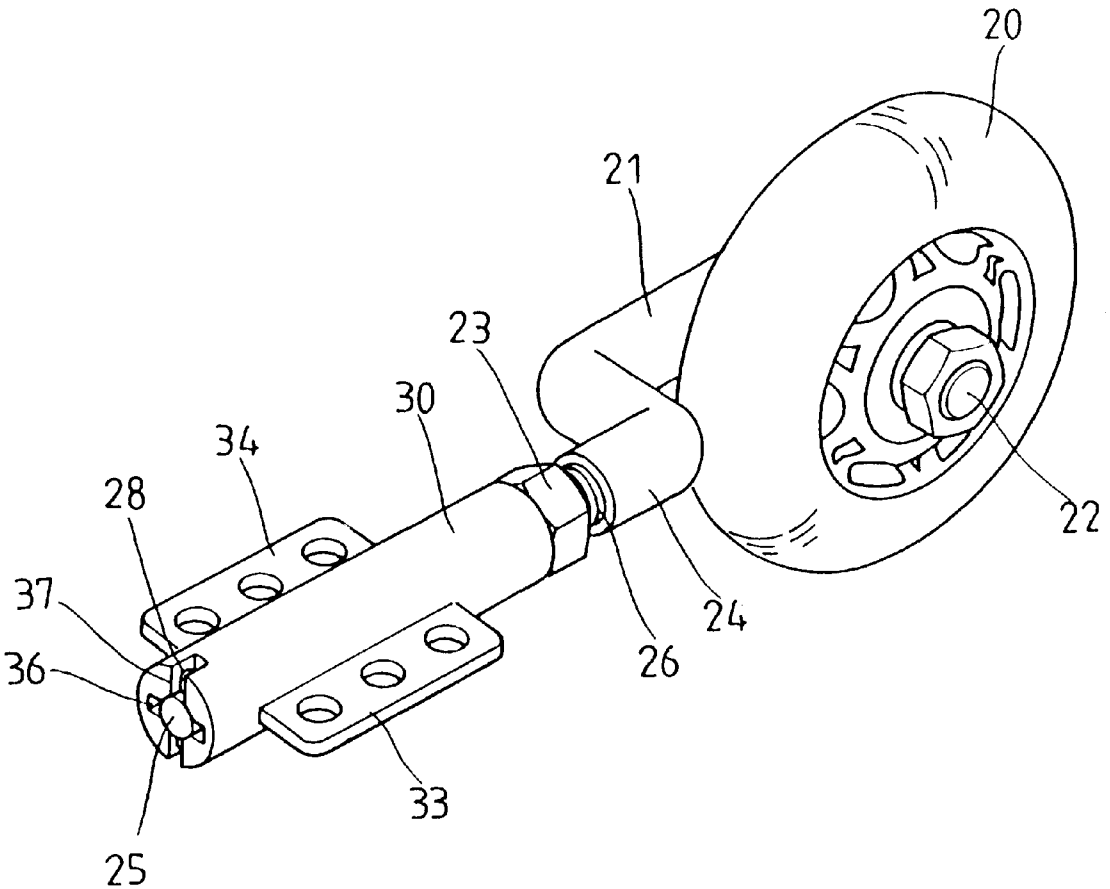
FIG. 5 is a perspective view of the rear wheel assembly in a locked state.
Figure 6:
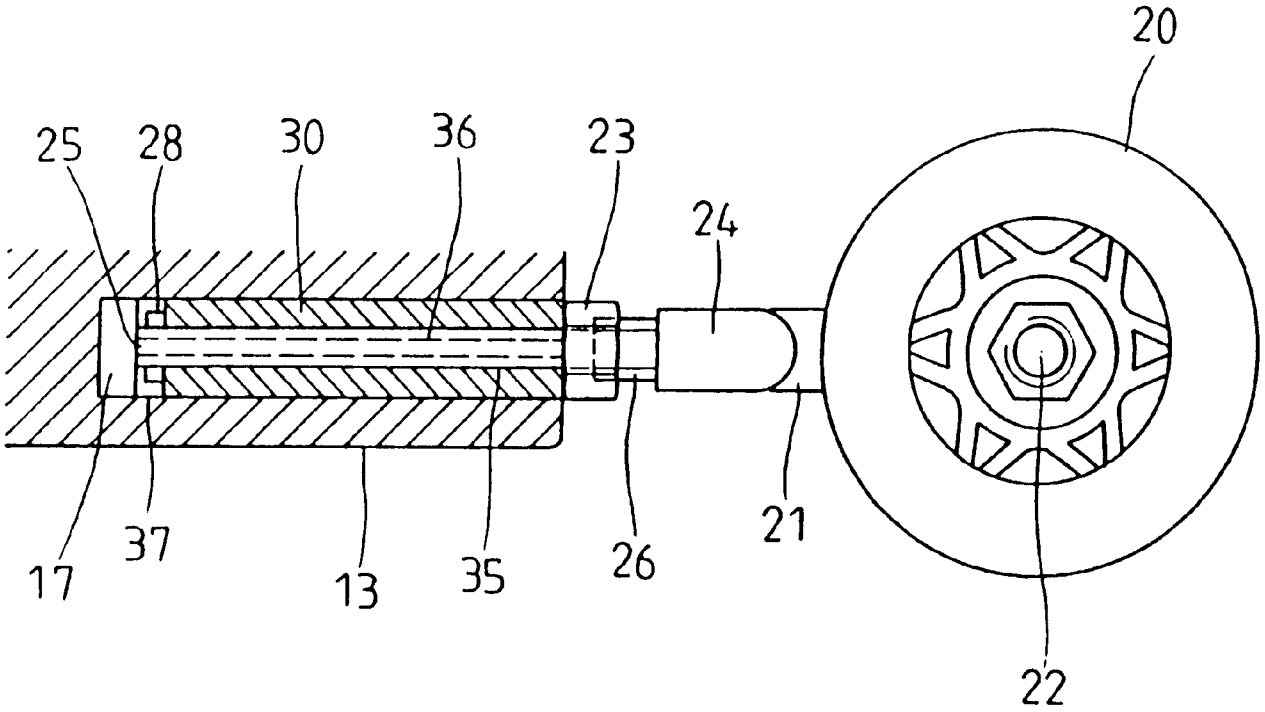
FIG. 6 is a side view, partly sectioned, of the rear wheel assembly and a rear portion of a sole plate of the three-wheel roller skate in accordance with the present invention.

In assembly, referring to FIG. 4, the reduced section 25 of the inner rod 24 is extended through the longitudinal hole 35 until the distal end of the reduced section 25 extending beyond the end of the connecting member 30. The pin 28 is extended through the transverse hole 27 of the reduced section 25. Next, the rear wheel 20 and the wheel rod 21 are turned through 90° and the pin 28 is seated in the groove 37 of the connecting member 30, as shown in FIG. 5. Next, the nut 23 is turned to move the rear wheel 20 and the wheel rod 21 away from the sole plate to a locked state where the nut 23 presses against the other end face of the connecting member 30. Assembly of the three-wheel roller skate is thus accomplished. In a preferred embodiment of the invention, the sole plate 13 has a receptacle 17 for receiving the connecting member 30, best shown in FIG. 6.

Figure 7:
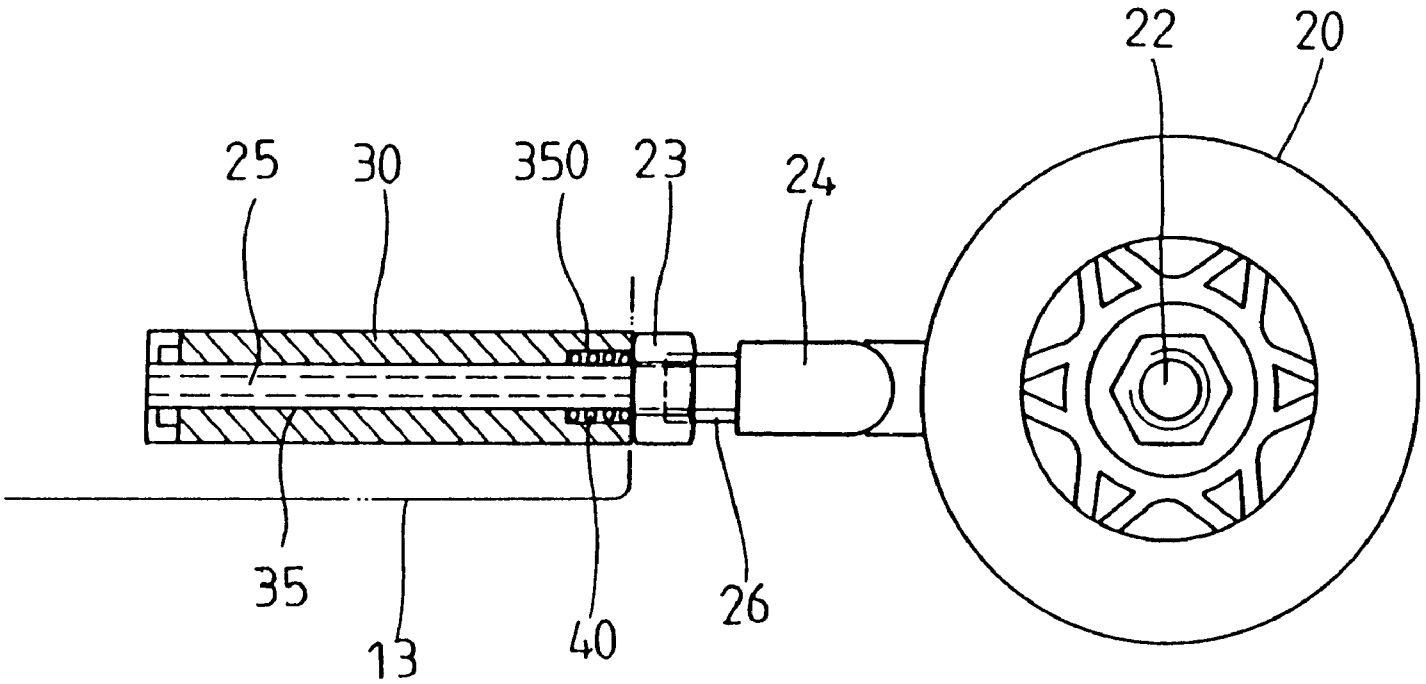
FIG. 7 is a sectional view illustrating a modified embodiment of the three-wheel roller skate in accordance with the present invention.

FIG. 7 illustrates a modified embodiment of the invention, wherein the longitudinal hole 35 of the connecting member 30 comprises an enlarged section 350 in an end thereof for receiving a spring 40 which is compressed after assembly to thereby provide a resilient force for preventing loosening of the rear wheel assembly.

Figure 8:
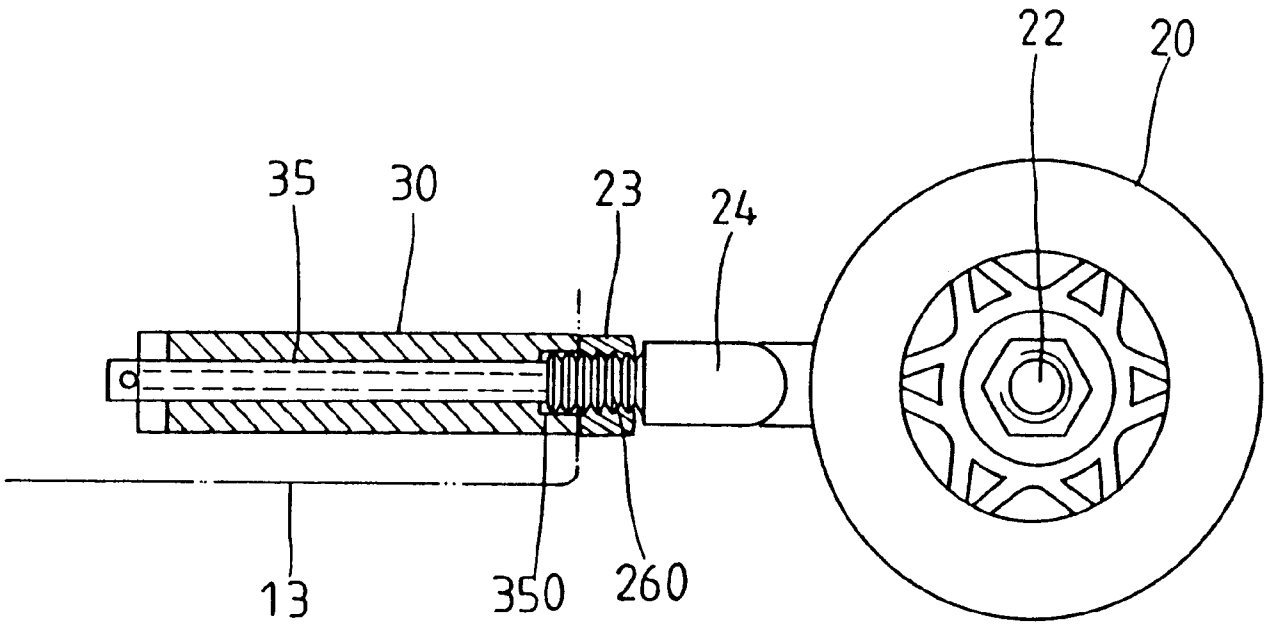
FIG. 8 is a sectional view illustrating another modified embodiment of the three-wheel roller skate in accordance with the present invention.
Figure 9:
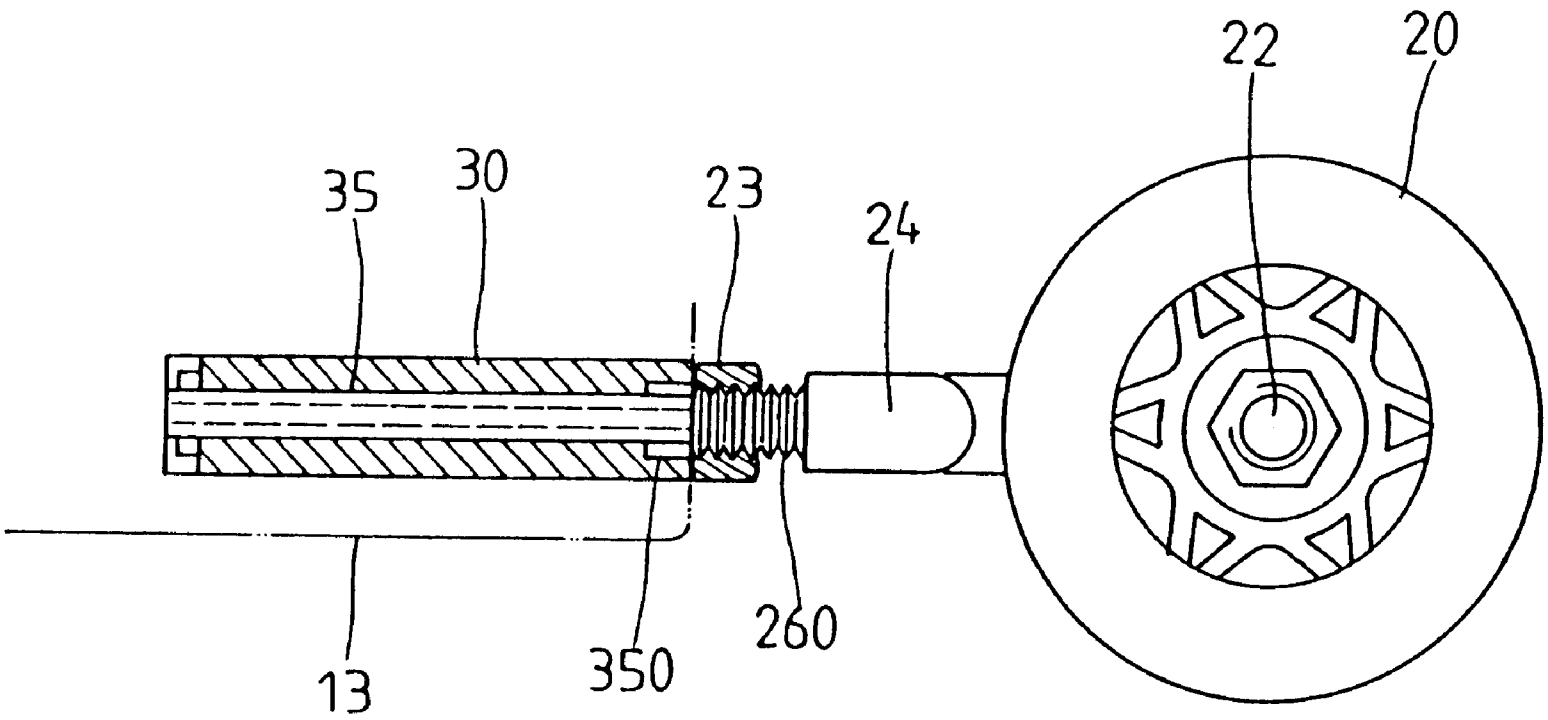
FIG. 9 is a sectional view similar to FIG. 8, wherein the rear wheel assembly is in a locked state.

FIG. 8 illustrates another modified embodiment of the invention, wherein the threaded section (now designated by 260) of the inner rod 24 is lengthened. The enlarged threaded section 260 of the inner rod 24 may enter the enlarged section 350 of the longitudinal hole 35 to thereby provide a more reliable relative axial movement between the inner rod 24 and the connecting member 30. FIG. 9 illustrates a locked state of the rear wheel assembly of the modified embodiment of FIG. 8.

Although the invention has been explained in relation to its preferred embodiment, it is to be understood that many other possible modifications and variations can be made without departing from the scope of the invention as hereinafter claimed.

What is claimed is:

1. A three-wheel roller skate comprising:

a sole plate comprising a front portion and a rear end;

two front wheels rotatably attached to the front portion of the sole plate; and a rear wheel assembly comprising a connecting member, a wheel rod, an inner rod, and a rear wheel, the connecting member being securely attached to the rear end of the sole plate and comprising a longitudinal hole, a longitudinal through-slot extending along the longitudinal hole and a groove, the groove being defined in a forward end face of the connecting member and extending along a direction at an angle with the longitudinal through-slot, the wheel rod comprising a first end and a second end, the second end of the wheel rod forming an axle to which the rear wheel is rotatably mounted, the rear wheel being located behind the rear end of the sole plate after assembly, the inner rod having a first end extending through the longitudinal hole of the connecting member and a second end integral with the first end of the wheel rod, the inner rod further comprising a threaded section adjacent the second end, a nut being engaged on the threaded section, a transverse hole being defined in the first end of the inner rod, a pin being extended through the transverse hole of the first end of the inner rod, the first end of the wheel rod being extendible beyond the forward end face of the connecting member and then rotatable through an angle for placing the pin into the groove of the connecting member, and the nut being rotatable to move the rear wheel and the wheel rod in a rearward direction relative to the connecting member to a locked state.

2. The three-wheel roller skate as claimed in claim 1, further comprising a spring mounted around the second end of the inner rod, the spring being compressed when the nut is in the locked state.

3. The three-wheel roller skate as claimed in claim 2, wherein the sole plate comprises a receptacle for receiving the connecting member.

4. The three-wheel roller skate as claimed in claim 1, wherein the longitudinal hole of the connecting member comprises an enlarged section in an end thereof, the threaded section of the inner rod being partially received in the enlarged section of the longitudinal hole of the connecting member.

5. The three-wheel roller skate as claimed in claim 3, wherein the sole plate comprises a receptacle for receiving the connecting member.

6. The three-wheel roller skate as claimed in claim 1, wherein the sole plate comprises a receptacle for receiving the connecting member.

7. The three-wheel roller skate as claimed in claim 1, wherein the wheel rod is substantially U-shaped having two limbs, and wherein one of the limbs forms the axle for the rear wheel.

8. The three-wheel roller skate as claimed in claim 1, wherein the pin has a length smaller that a width of the longitudinal through-slot.

9. The three-wheel roller skate as claimed in claim 1, wherein the nut presses against another end face of the connecting member when in the locked state.

10. The three-wheel roller skate as claimed in claim 1, wherein the first end of the inner rod has a diameter smaller than that of the second end of the inner rod.

* * * * *